United States Patent [19]

Manson

[11] 4,424,683

[45] Jan. 10, 1984

[54] ICE MAKER CONTROL

[75] Inventor: Larry J. Manson, Lincoln Township, Berrien County, Mich.

[73] Assignee: Whirlpool Corporation, Benton Harbor, Mich.

[21] Appl. No.: 424,491

[22] Filed: Sep. 27, 1982

[51] Int. Cl.[3] ..... F25C 1/00

[52] U.S. Cl. ..... 62/135; 62/233

[58] Field of Search ..... 62/135, 340, 233, 231; 236/46 R; 165/12

[56] References Cited

U.S. PATENT DOCUMENTS

| | | | |
|---|---|---|---|
| 3,449,919 | 6/1969 | Fox | 62/71 |
| 3,648,478 | 3/1972 | Linstromberg | 62/233 X |
| 3,714,794 | 2/1973 | Linstromberg et al. | 62/233 X |
| 3,964,270 | 6/1976 | Dwyer | 62/233 X |
| 3,977,851 | 8/1976 | Toya | 62/135 |
| 4,172,555 | 10/1979 | Levine | 236/46 R |
| 4,257,237 | 3/1981 | Hoensch | 62/233 X |
| 4,292,812 | 10/1981 | Kakinuma et al. | 62/233 X |

*Primary Examiner*—William E. Wayner

*Attorney, Agent, or Firm*—Wood, Dalton, Phillips, Mason & Rowe

[57] ABSTRACT

A control for controlling the time at which ice is harvested from an ice maker as a function of the temperature conditions within a below-freezing compartment in which the ice maker is located. The control includes sensing means for sensing the temperature within the compartment, first calculating means for calculating at preselected time intervals a time-related number based on a first temperature-dependent function when the temperature sensed by the sensing means is above a predetermined temperature, and second calculating means for calculating at the preselected time intervals a time-related number based on a second temperature-dependent function when the temperature sensed by the sensing means is at or below the predetermined temperature. The control further includes means for accumulating temperature-dependent time increments based on said calculated numbers and comparing the accumulated sum to a predetermined amount to determine whether an ice harvesting operation should be initiated. The apparatus further includes structure for effecting ice harvesting when the predetermined amount of temperature-dependent time increments has been accumulated.

17 Claims, 4 Drawing Figures

FIG. 1
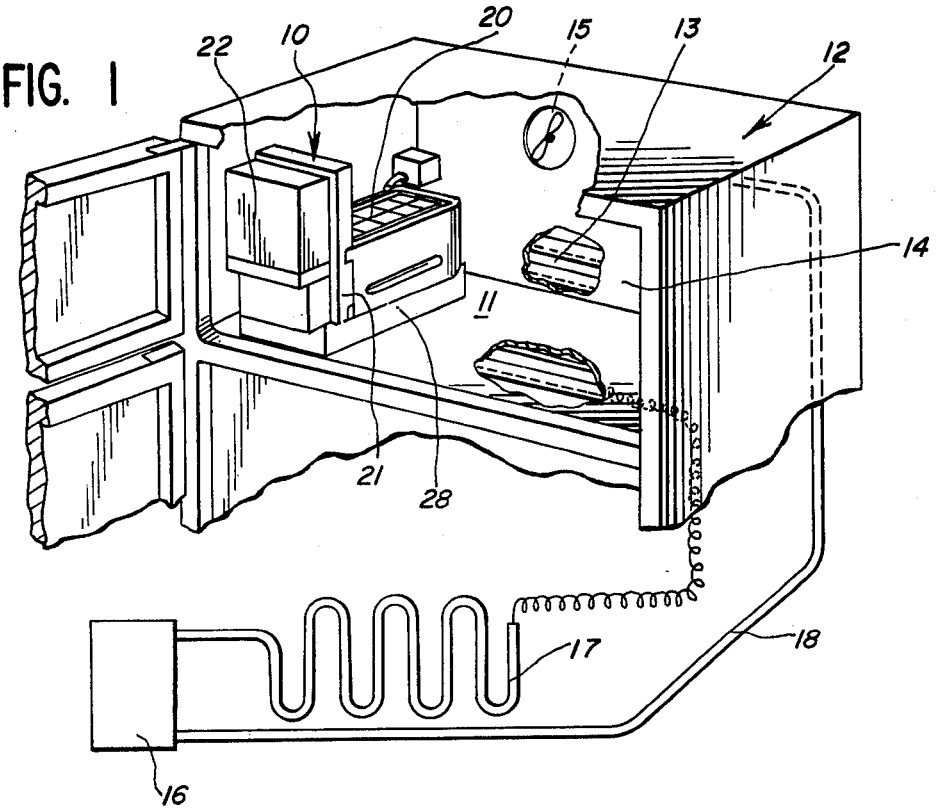
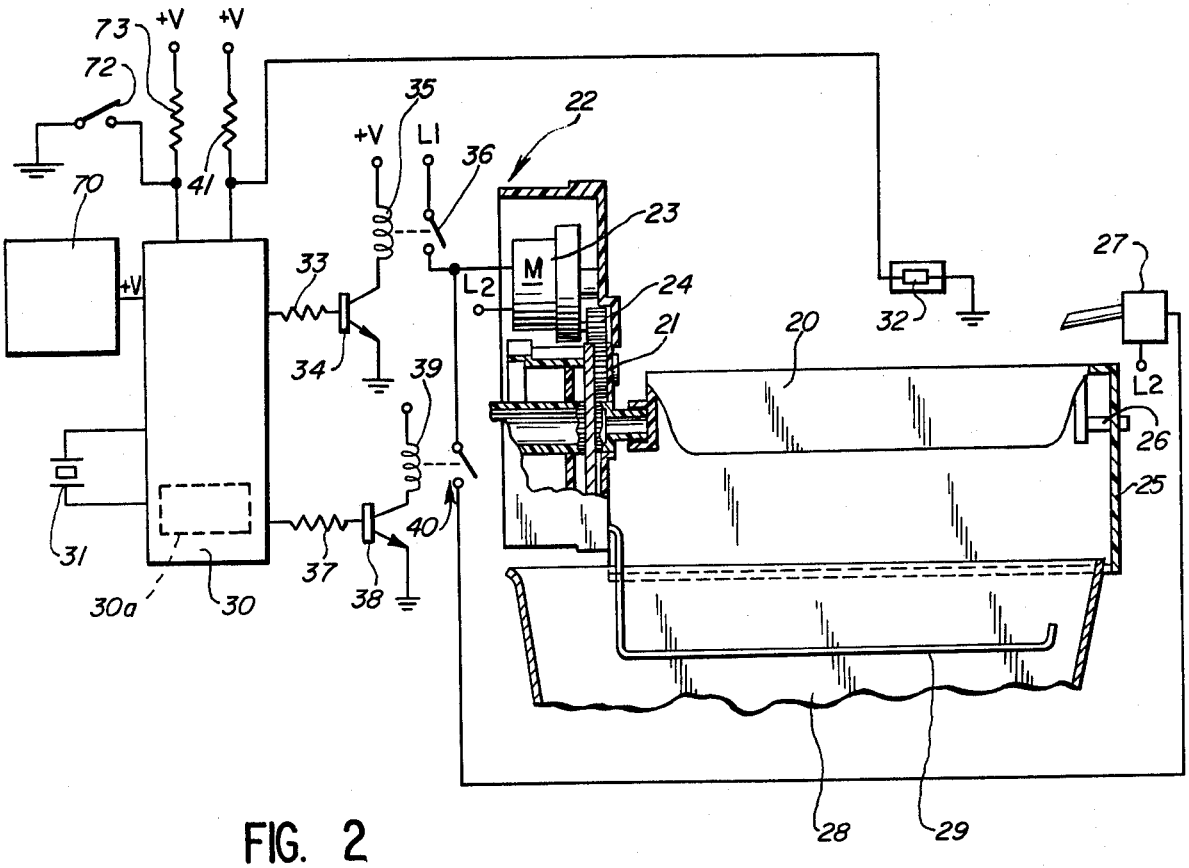
FIG. 2

ICE MAKER CONTROL

BACKGROUND OF THE INVENTION

1. Field of the Invention

This invention relates to refrigeration apparatus and in particular to means for controlling timing of the harvesting of ice from an ice maker as a function of the temperature of the compartment in which the ice maker is disposed.

2. Description of the Background Art

It is conventional in ice maker controls to effect a harvesting operation of the formed ice as a function of the temperature within the freezing compartment in which the ice maker is disposed. The length of the timed ice making cycle is varied according to the sensed temperature, and the length of the ice making cycle is based on an assumption that the rate at which the ice forms is a linear function of the temperature within the freezing compartment.

It has been found, however, that such controls are at times inaccurate in initiating the harvesting cycle either before the ice is completely formed, or maintaining the ice making cycle for too long a period, wasting energy in the continual cooling of the completely formed ice before the harvesting cycle is initiated.

A number of different systems for controlling the ice making and harvesting cycles have been disclosed in prior art patents. Illustratively, in U.S. Pat. No. 3,648,478 of William J. Linstromberg, which patent is owned by the assignee hereof, an ice maker control is disclosed wherein the means for timing the ice making operation is caused to operate only when the compressor is energized so as to cause the compressor run time to determine the length of the ice making cycle. Thus, after a predetermined amount of compressor run time is accumulated, the control automatically terminates the ice making operation and initiates the ice harvesting operation.

Another form of ice making apparatus means is illustrated in U.S. Pat. No. 3,714,794 of William J. Linstromberg et al, which patent is also owned by the assignee hereof. In this patent, a timer motor operates continuously other than when the temperature in the freezer compartment rises above a preselected temperature at which it is undesirable to effect further operation of the ice maker.

SUMMARY OF THE INVENTION

The present invention comprehends an improved ice maker control wherein timing of the ice making operation is determined by different temperature-dependent functions, based on a determination of whether the temperature in the freezer compartment is above or below a predetermined temperature.

The control is based on a non-linear functional relationship between the compartment temperature and the freezing time, so as to provide an improved, accurate timing of the ice making operation effectively eliminating under-freezing of the ice or wasteful long continuation of the ice making cycle. As a result, improved efficiency in the ice making operation and accurate control of the length of the ice making cycle are provided.

In broad aspect, the invention comprehends the provision of an improved ice maker control including means for sensing the temperature to which water in the ice maker is exposed, means for calculating and storing a number which corresponds to the cumulative sum of individual temperature-dependent time increments which are periodically determined, and means for initiating an ice harvesting operation when the stored number reaches a predetermined number.

More specifically, the invention comprehends the provision in a refrigeration apparatus having means defining a below-freezing compartment, an ice maker located within the compartment, and ice harvesting means for selectively harvesting ice from the ice maker, of an improved ice maker control including sensing means for sensing the temperature within the compartment adjacent the ice maker, first calculating means for calculating, at preselected time intervals, a time-related number based on a first temperature-dependent function when the temperature sensed by the sensing means is above a predetermined temperature, second calculating means for calculating at said preselected time intervals, a time-related number based on a second temperature-dependent function when the temperature sensed by the sensing means is at or below the predetermined temperature, means for accumulating the sum of the time-related numbers at the end of each preselected time interval, and means for operating the ice harvesting means when a preselected amount of the time-related numbers has been accumulated.

The invention further comprehends that different calculations be effected depending on whether or not air is being forcibly circulated through the freezer compartment by air moving means. More specifically, the invention comprehends the provision of additional third and fourth calculating means for calculating the appropriate time-related numbers when the air moving means is operating.

In the illustrated embodiment, the control periodically accumulates and stores temperature-dependent time increments which are defined by $\Delta t/t$, where $\Delta t$ is at a preselected time interval and t is the time required to freeze water at the measured compartment temperature.

The time t is determined by the function of $(T-b)/m$ where T is the sensed temperature at a particular time, b is a constant, and m is the slope, at the sensed temperature, of curves which define the relationship between compartment temperatures and the time normally necessary to form ice at different compartment temperatures.

It has been found that the slope of the curves is substantially smaller for temperatures above the predetermined temperature than it is for temperatures below the predetermined temperature.

In the illustrated embodiment, the curves are based on a combination of the times required for sensible cooling and latent cooling of the water in the ice maker.

The invention further comprehends the improved method of controlling the length of an ice making cycle including the steps of calculating a time-related member as a first temperature-dependent function when the temperature of the air is above a predetermined temperature, calculating a time-related number as a second temperature-dependent function when the temperature of the air is at or below the predetermined temperature, and using the calculated time-related numbers to cause termination of a freezing cycle and initiation of a harvesting operation.

In the illustrated embodiment, the calculations are made at one-minute intervals.

Thus, the invention comprehends an improved method and apparatus for controlling the operation of an ice maker which is extremely simple and economical of construction while yet providing the highly desirable features discussed above.

BRIEF DESCRIPTION OF THE DRAWINGS

Other features and advantages of the invention will be apparent from the following description taken in connection with the accompanying drawings wherein:

FIG. 1 is a fragmentary perspective view of a refrigeration apparatus having an ice maker provided with a control means embodying the invention;

FIG. 2 is a fragmentary side elevation of the ice maker with portions broken away and with the associated electrical circuitry illustrated schematically;

DESCRIPTION OF THE PREFERRED EMBODIMENT

Figure 3:
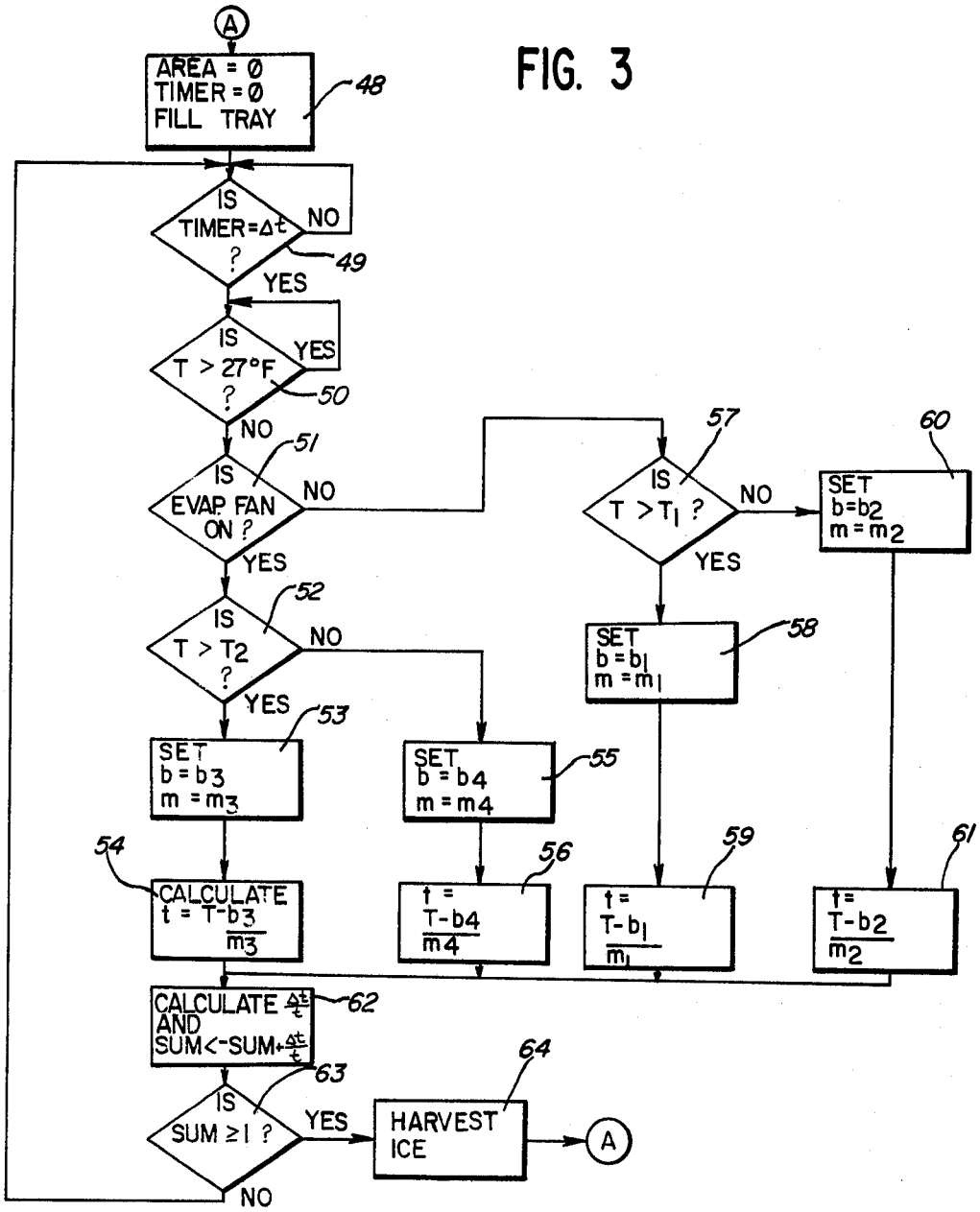
FIG. 3 is a flow chart illustrating the method of determining the timing of the ice forming and harvesting operations.

In the illustrative embodiment of the invention, an ice maker generally designated 10 is mounted in a compartment 11 of a refrigeration apparatus 12. The air in compartment 11 is maintained at a below-freezing temperature by a suitable evaporator 13 in the rear wall 14.

In the illustrated embodiment, air moving means comprising an evaporator fan 15 is provided for forcibly circulating air from the compartment 11 in heat exchange relationship with the evaporator coil 13. The evaporator fan 15 is thermostatically controlled in a conventional manner so as to maintain the compartment at a below-freezing temperature at all times.

As shown in FIG. 1, the refrigeration apparatus further includes a compressor 16 for providing refrigerant to a condenser 17, from which the refrigerant is fed to the evaporator coil 13 by way of a capillary tube. A return line 18 is provided for returning the refrigerant from the evaporator coil to the suction side of the compressor 16.

In the illustrated embodiment, the ice maker is provided with a flexible tray 20 which is periodically inverted and twisted by suitable mechanism 21 to free the formed ice bodies in the tray cavities and permit harvesting of the ice bodies. This is accomplished by turning the tray about its longitudinal axis so as to dump the freed ice bodies therefrom into the compartment space 11 below the ice maker, as seen in FIG. 1. Control of the ice forming and ice harvesting operations is effected by a control generally designated 22 and disposed adjacent the twist mechanism 21.

As shown in FIG. 2, control 22 includes a timer motor 23 which drives the twist mechanism 21 through a series of gears 24. As shown, a distal end of tray 20 is mounted to a housing portion 25 by a connector 26. Water is periodically delivered into the tray through a water valve 27. The freed ice bodies are received in a bin 28 subjacent the tray. A sensing arm 29 is connected to the control 22 for sensing the level of ice in bin 28 and causing automatic termination of the ice making cycle when the level of ice collected therein reaches a preselected high level.

As indicated briefly above, the invention comprehends improved control of the ice making and harvesting cycles. As shown in FIG. 2, the control includes a microcomputer 30, such as a Texas Instrument TMS-2100 commercially available microcomputer. A clock crystal 31 is provided for establishing a timing signal for use by the computer, and the computer is operated from a conventional regulated power supply 70.

In addition to the timing signal from crystal 31, the microcomputer receives input from a temperature sensor 32 disposed adjacent the ice maker. The microcomputer also receives an input which indicates whether or not the evaporator fan 15 is energized. As shown in FIG. 2, this input may be provided by a set of relay contacts 72 connected with a pull-up resistor 73 which is connected between the output of the regulated supply and the microcomputer input, where the contacts 72 are controlled by a relay (not shown) which is energized concurrently with the evaporator fan 15.

A first output from the microcomputer 30 is provided through a resistor 33 to a transistor 34 controlling energization of a relay coil 35 for selectively closing a normally open switch 36 connected between power supply lead L1 and the timer motor 23.

A second output from the microcomputer is provided through a resistor 37 to a second transistor 38 for controlling a relay coil 39. Energization of coil 39 selectively closes a normally open switch 40 connected in series with switch 36 to the water valve 27.

In the illustrated embodiment, temperature sensor 32 comprises a thermistor which is connected with a resistor 41 to form a voltage divider across the output of the regulated power supply 70. The output of this voltage divider provides a temperature-dependent voltage input to the microcomputer 30, as shown. Each of the relay coils 35 and 39 is connected to the output of the regulated power supply.

Microcomputer 30 is programmed to provide an improved control of the ice making cycle as a function of the temperature to which the tray 20 is exposed, as sensed by thermistor 32. More specifically, the microcomputer controls the harvesting of ice from the ice maker by accumulating in a register **30*a*, the sum of individual temperature-dependent time increments which are determined in accordance with a first temperature-dependent function when the temperature of the air sensed by thermistor 32 is above a predetermined temperature and determined in accordance with a second temperature-dependent function when the temperature of the air sensed by thermistor 32** is at or below the predetermined temperature, and initiating an ice harvesting operation when a predetermined amount of time increments, indicative of complete ice formation, has been accumulated.

Figure 4:
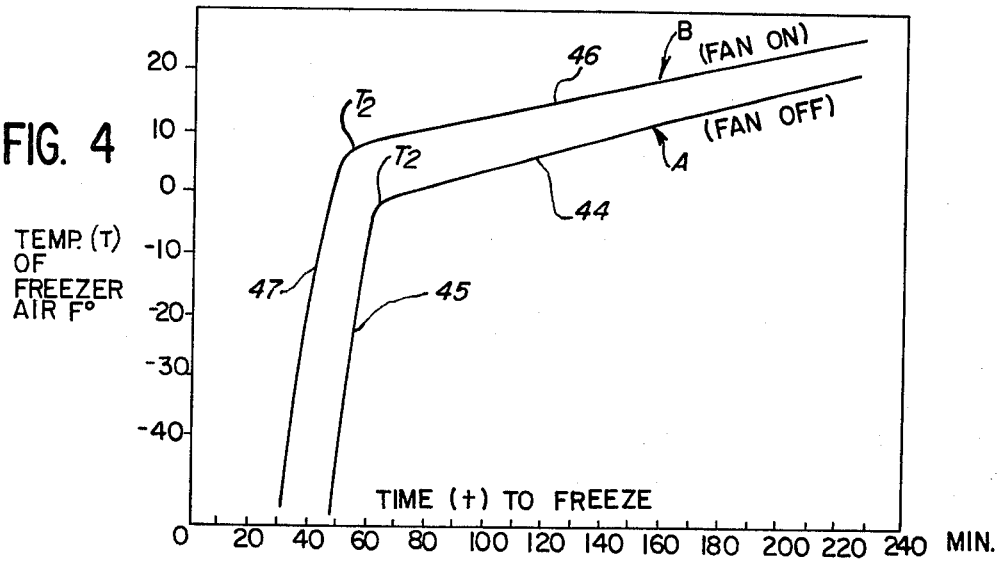
FIG. 4 is a graph illustrating the time/temperature curves for forming ice in the ice maker under evaporator fan-on and evaporator fan-off conditions.

As illustrated in FIG. 4, the time actually required to freeze water in the ice maker tray 20 of a typical domestic refrigeration apparatus has been found to differ substantially from the linear function relationship with freezer compartment temperature heretofore utilized in the timed ice making cycle controls of the prior art. Specifically, the functional relationship between the compartment air temperature, to which the tray 20 is exposed, and the time required to freeze the water in the tray changes appreciably at a particular fixed temperature. As illustrated, a different functional relationship also exists between time and temperature depending on whether the evaporator fan is on or off. Thus, as shown in FIG. 4, curve A illustrates the time necessary to freeze the water in the tray where the compartment temperature is above and below a first predetermined temperature $T_1$, with the evaporator fan de-energized. Curve B illustrates the time necessary to freeze the water at different temperatures above and below a second predetermined temperature $T_2$ when the evaporator fan is energized.

Curves A and B show that the time required to freeze water in the tray 20 decreases in a generally linear manner as the temperature decreases, until a temperature is reached below which additional temperature reduction provides only a small decrease in freezing time. As illustrated, although the total time-temperature relationship defined by curve A or B is non-linear, each of the curves A or B can be approximated by two linear functions which intersect at point $T_1$ or $T_2$, respectively.

Thus, the portion 44 of curve A above predetermined temperature $T_1$ can be described by the equation $y=m_1x+b_1$, and the portion 45 of the curve A below the predetermined temperature $T_1$ can be described by the equation $y=m_2x+b_2$. Similarly, the portion 46 of curve B above the predetermined temperature $T_2$ can be described by the equation $y=m_3x+b_3$, and the portion 47 of curve B below the predetermined temperature $T_2$ can be described by the equation $y=m_4x+b_4$. The curves of FIG. 4 were determined empirically with an ice maker such as shown in FIG. 1, wherein approximately 225 milliliters of water were provided in the tray. The curves illustrate the total time required to effect both sensible cooling and latent cooling, where sensible cooling refers to the time required to cool the water from an initial temperature of 90° F. to 32° F. and latent cooling refers to the time required to solidly freeze the water at 32° F. water temperature.

The different characteristics of the curve portions above and below the predetermined temperatures are utilized in a novel manner in control 22 by means of the microcomputer 30 to provide improved accuracy of the ice making and harvesting cycles in the ice making apparatus. More specifically, as illustrated in the flow chart of FIG. 3, the program is entered at A to start at block 48 wherein an internal timer of the microcomputer is set at zero and transistor 38 is caused to energize coil 39 for a suitable period of time to provide the desired quantity of water to the ice maker tray 20. As indicated above, the water may be provided at ambient temperature, such as up to 90° F.

The program then continues to the decisional block 49 wherein a determination is made as to whether the timer has reached a desired time, $\Delta t$, thereby establishing a desired time interval between the temperature samplings and calculations made by the control. This time interval should be much shorter than the total time required to freeze the water in tray 20 and, by way of example, may be equal to one minute. Thus, when the timer reaches $\Delta t$, the "yes" determination of block 49 continues the program to decisional block 50 wherein a temperature comparison is made, to determine whether the sensed temperature T, sensed by thermistor 32, is above a predetermined high temperature, such as 27° F. If the determination is "yes", the program repeats the temperature comparison until such time as the temperature in the compartment drops below the predetermined high temperature to reliably effect freezing of the water in the tray.

Upon a determination that the sensed temperature is at or below the preselected high temperature, the program continues to decisional block 51 wherein a determination is made as to whether the evaporator fan 15 is energized.

If the fan is energized, the "yes" determination in decisional block 51 continues to program to decisional block 52 wherein a determination is made as to whether the sensed temperature is above the predetermined temperature $T_2$. If the determination is that the temperature is above the predetermined temperature $T_2$, the program continues to block 53 wherein the calculation parameters of b and m are set at $b=b_3$ and $m=m_3$. The program then continues to calculation block 54 wherein the computer calculates $t=(T-b_3)/m_3$, where t represents the time in minutes that it would take to freeze the water in tray 20 at a constant temperature T, as defined by curve B.

If the determination at decisional block 52 is that the temperature is less than the predetermined temperature $T_2$, the program alternatively continues to block 55 wherein the parameters of b and m are set at $b=b_4$ and $m=m_4$. From block 55, the program continues to block 56 wherein the computer calculates $t=(T-b_4)/m_4$.

If the determination at decisional block 51 is that the evaporator fan is off, the program continues from block 51 to decisional block 57 wherein a determination is made as to whether the sensed temperature is greater or less than the predetermined temperature $T_1$ of curve A. If the determination is that the temperature is above the predetermined temperature $T_1$, the program continues to block 58 wherein the parameters of b and m are set at $b=b_1$ and $m=m_1$. The program then continues to block 59 wherein the computer calculates $t=(T-b_1)/m_1$.

If the determination at decisional block 57 is that the temperature sensed by sensing means 32 is at or below the predetermined temperature $T_1$, the program continues to block 60 wherein the parameters b and m are set at $b=b_2$ and $m=m_2$. The program then continues on to block 61 wherein the computer calculates $t=(T-b_2)/m_2$.

As indicated above the calculations in blocks 54, 56, 59 and 61 comprise determinations, in terms of the sensed temperature T and the set b and m parameters defined by curves A and B, of a number corresponding to the total time t which would be required to freeze water in tray 20 if the temperature were to remain constant at the measured value T over the entire ice making cycle. Since the sensed temperature T does not remain constant, the program continues from the appropriate block 54, 56, 49 or 61 to block 62 which calculates and accumulates the sum $\Delta t/t$ calculations, where $\Delta t$ is the time interval between calculations and, as discussed above, in the illustrated embodiment, comprises one minute. The block 62 accumulates the sum of all the periodic calculations of $\Delta t/t$ during an ice making cycle. Assuming that the tray 20 is always exposed to a temperature of 27° F. or less, accumulation or incremental summing of the $\Delta t/t$ calculations is effected once during each time interval $\Delta t$.

The time interval $\Delta t$ is much smaller than the time-to-freeze t, and each calculation $\Delta t/t$ thus represents a time increment having a magnitude which is dependent on the sensed temperature T. Where, as in the illustrated embodiment, $\Delta t$ is equal to one minute, the ice making cycle will be complete when the sum of the calculated temperature-dependent time increments is equal to one.

The program thus continues from block 62 to decisional block 63 wherein a determination is made as to whether the incremental sum of temperature-dependent time increments is greater than or equal to 1, indicating that ice formation is complete. Until such time as the sum is greater than or equal to 1, the program continues from the "no" output of block 63 back to input B leading to decisional block 49 so as to repeat the above discussed determinations and incremental summing during each time interval Δt, such as the one-minute time interval of the illustrated embodiment.

When the total incremental sum determined in block 62 is greater than or equal to 1 as determined in decisional block 63, the "yes" output of block 63 continues to control block 64 which causes actuation of transistor 34 to thereby energize coil 35 and close contact 36, thereby energizing the ice maker drive motor 23 to effect initiation of the harvesting cycle.

As illustrated in FIG. 3, after the harvesting cycle the program returns to input A to initiate a subsequent controlled ice forming cycle.

Thus, the control technique illustrated in FIG. 3 provides an ice making cycle which is variable in length and correlated with the sensed temperature to which the ice maker is exposed, in accordance with different slopes of the curves A and B illustrated in FIG. 4. The invention provides improved accuracy in the control of the ice making cycles by taking into consideration the fact that the rate at which the ice forms in the tray increases in a substantially linear fashion with decreasing temperature down to a predetermined temperature, and when the temperature decreases further below the predetermined temperature, the rate of ice formation increases only slightly.

The curves A and B, as discussed above, are empirically determined and, in the illustrated embodiment, pertain to a conventional plastic ice tray provided with approximately 225 milliliters of water at an initial temperature of 90° F. The knee of the curves and the curves themselves will vary somewhat depending on the particular air flow of the refrigeration apparatus in which the ice maker is located.

Thus in broad aspect, the invention comprehends the provision of an ice maker control which recognizes that the rate of ice formation is a non-linear function of temperature and which controls the ice making cycle in accordance with a characteristic time-temperature curve for the ice maker. The rate of ice formation has been found to change abruptly in the region of a particular temperature, below which only a small increase in freezing rate has been found to take place as the temperature is further reduced. The improved control of the ice making cycle timing tends to prevent improper harvesting prior to complete formation of the ice and excessively long ice-forming cycles, thereby maximizing the amount of ice which can be produced over an extended period of time.

As will be obvious to those skilled in the art, the program illustrated in FIG. 3 is exemplary only. Thus, variations from the program are contemplated within the scope of the invention.

The foregoing disclosure of specific embodiments is illustrative of the broad inventive concepts comprehended by the invention.

Having described the invention, the embodiments of the invention in which an exclusive property or privilege is claimed are defined as follows:

1. In a refrigeration apparatus having means defining a below-freezing compartment, an ice maker located within said compartment, and ice harvesting means for selectively harvesting ice from said ice maker, an improved ice maker control comprising:

sensing means for sensing the temperature to which water in said ice maker is exposed;

means for calculating and storing a number which represents the cumulative sum of individual numbers which are periodically determined based on a first temperature-dependent function when said sensed temperature is above a predetermined temperature and based on a second temperature-dependent function when said sensed temperature is at or below said predetermined temperature; and, means for initiating operation of said ice harvesting means when said stored number reaches a predetermined number.

2. The refrigeration apparatus of claim 1 wherein said first and second temperature-dependent functions define the relationship between said sensed temperature and the time required to freeze water in said ice maker.

3. In a refrigeration apparatus having means defining a below-freezing compartment, an ice maker located within said compartment, and ice harvesting means for selectively harvesting ice from said ice maker, an improved ice maker control comprising:

sensing means for sensing the temperature to which water in said ice maker is exposed;

means for periodically calculating a number which corresponds to the time required to freeze water in the ice maker at the sensed temperature;

means for calculating a temperature-dependent time increment by dividing a constant by said calculated number;

means for storing the cumulative sum of said time increments; and, means for initiating operation of said harvesting means when said cumulative sum reaches a predetermined amount.

4. The refrigeration apparatus of claim 3 wherein said constant is defined by the duration of the time interval between the periodic calculations of said number.

5. In a refrigeration apparatus having means defining a below-freezing compartment, an ice maker located within said compartment, and ice harvesting means for selectively harvesting ice from said ice maker, an improved ice maker control comprising:

sensing means for sensing the temperature within said compartment adjacent said ice maker;

first calculating means for calculating at predetermined time intervals a number having a magnitude determined by a first temperature-dependent function when the temperature sensed by said sensing means is above a predetermined temperature;

second calculating means for calculating at predetermined time intervals a number having a magnitude determined by a second temperature-dependent function when the temperature sensed by said sensing means is at or below said predetermined temperature;

means for periodically calculating temperature-related time increments which are a function of said preselected time interval and the calculated number and accumulating the sum of said increments; and, means for initiating operation of said ice harvesting means when a predetermined amount of said increments has been accumulated.

6. In a refrigeration apparatus having means defining a below-freezing compartment, air moving means for circulating below-freezing temperature air through said compartment, an ice maker located within said compartment, and ice harvesting means for selectively harvesting ice from said ice maker, an improved ice maker control comprising:

sensing means for sensing the temperature within said compartment adjacent said ice maker;

first calculating means for calculating at predetermined time intervals a number having a magnitude determined by a first temperature-dependent function when the temperature sensed by said sensing means is above a first predetermined temperature and said air moving means is inoperative;

second calculating means for calculating at said predetermined time intervals a number having a magnitude determined by a second temperature-dependent function when the temperature sensed by said sensing means is at or below said first predetermined temperature and said air moving means is inoperative;

third calculating means for calculating at predetermined time intervals a number having a magnitude determined by a third temperature-dependent function when the temperature sensed by said sensing means is above a second predetermined temperature and said air moving means is operating;

fourth calculating means for calculating at said predetermined time intervals a number having a magnitude determined by a fourth temperature-dependent function when the temperature sensed by said sensing means is at or below said second predetermined temperature and said air moving means is operating;

means for calculating temperature-dependent time increments which are a function of said preselected time interval and said calculated number and accumulating the sum of said increments; and, means for initiating operation of said ice harvesting means when a predetermined amount of said increments has been accumulated.

7. The refrigeration apparatus of claims 5 or 6 wherein said means for calculating and accumulating said increments determines said increments as a function of $\Delta t/t$ where $\Delta t$ is said preselected time interval, and t is said calculated number determined by one of said temperature-dependent functions.

8. The refrigeration apparatus of claims 5 or 6 wherein said calculated numbers are determined by calculating $(T-b)/m$ where T is the sensed temperature, b is a constant, and m is the slope at said sensed temperature of a curve of the relationship between compartment temperature and the time normally necessary to form ice at different compartment temperatures, whereby each of said calculated numbers represents the time required to form ice at the sensed temperature T.

9. The refrigeration apparatus of claims 5 or 6 wherein said calculated numbers are determined by calculating $(T-b)/m$ where T is the sensed temperature, b is a constant, and m is the slope at said sensed temperature of a curve of the relationship between compartment temperature and the time normally necessary to form ice at different compartment temperatures, said slope being substantially smaller for temperatures above said predetermined temperatures than for temperatures below said predetermined temperatures.

10. The refrigeration apparatus of claims 5 or 6 wherein said ice harvesting means comprises electrically energizeable ice harvesting means.

11. The method of controlling an automatic ice making apparatus in which water is frozen in an ice tray which is subjected to below-freezing temperatures, said apparatus including electrically energizeable ice harvesting means, comprising the steps of:

sensing the temperature to which the water in said ice maker is exposed;

calculating, at predetermined time intervals, a number which represents a temperature-dependent time increment and which is based on a first temperature-dependent function when the sensed temperature is above a predetermined temperature and based on a second temperature-dependent function when the sensed temperature is at or below said predetermined temperature; and initiating an ice harvesting operation when the cumulative sum of said calculated numbers reaches a predetermined amount.

12. The method of controlling an ice maker of claim 11 wherein said numbers are calculated based on different temperature-dependent functions depending on whether or not below-freezing air is being forcibly circulated in heat transfer association with said water in said ice maker.

13. The method of controlling an ice maker of claim 11 wherein said step of calculating said time units is effected at fixed time intervals having a length which is much less than the time required to freeze water in said ice maker.

14. The method of controlling an ice maker of claim 11 wherein said step of initiating an ice harvesting operation comprises the steps of comparing the cumulative sum of said calculated numbers with a predetermined number and energizing said ice harvesting means when said cumulative sum reaches or exceeds said predetermined number.

15. The method of controlling an ice maker of claim 11 wherein said step of calculating said number representing a temperature-dependent time increment comprises the steps of calculating a first number which is proportional to the time required to freeze water in said ice maker and dividing a constant by said first number to obtain said number representing said increment.

16. The method of controlling an ice maker of claim 15 wherein the magnitude of said first calculated number is equal to the time required to freeze water in said ice maker at said sensed temperature and said constant is equal to the time interval between said calculations.

17. The method of controlling an ice maker of claim 15 wherein said first calculated number comprises a function of $(T-b)/m$, where T is the sensed temperature, b is a second constant, and m is the slope at said sensed temperature of a curve of the relationship between temperature and the time normally necessary to form ice at different temperatures.

* * * * *